United States Patent [19]

Viellefont et al.

[11] 4,436,606

[45] Mar. 13, 1984

[54] ELECTROLYSIS APPARATUS

[75] Inventors: Jean F. Viellefont, Herenthout; Carolus M. Hens, Olen; Hubert J. Tobback, Lichtaart, all of Belgium

[73] Assignee: Metallurgie Hoboken-Overpelt, Brussels, Belgium

[21] Appl. No.: 432,925

[22] PCT Filed: Feb. 17, 1982

[86] PCT No.: PCT/BE82/00002

§ 371 Date: Sep. 30, 1982

§ 102(e) Date: Sep. 30, 1982

[87] PCT Pub. No.: WO82/02907

PCT Pub. Date: Sep. 2, 1982

[30] Foreign Application Priority Data

Feb. 19, 1981 [LU] Luxembourg ..... 83152

[51] Int. Cl.[3] ..... C25D 17/08

[52] U.S. Cl. ..... 204/225; 204/297 R; 204/286; 204/288

[58] Field of Search ..... 204/106, 198, 225, 288, 204/286, 267, 268, 269, 270, 297 R

[56] References Cited

U.S. PATENT DOCUMENTS

| | | | |
|---|---|---|---|
| 1,501,692 | 7/1924 | Ward | 204/286 |
| 3,480,526 | 11/1969 | Duclaux | 204/225 |
| 3,697,404 | 10/1972 | Paige | 204/267 |
| 3,821,097 | 6/1974 | Ettel | 204/106 |
| 3,929,614 | 12/1975 | Hidohira | 204/286 |
| 4,028,211 | 6/1977 | Hirakawa et al. | 204/267 |
| 4,061,559 | 12/1977 | Kitamura et al. | 204/106 |
| 4,326,937 | 4/1982 | Neumeier et al. | 204/225 |
| 4,392,934 | 7/1983 | Viellefont et al. | 204/198 |

FOREIGN PATENT DOCUMENTS

| | | | |
|---|---|---|---|
| 2935765 | 5/1979 | Fed. Rep. of Germany | 204/225 |
| 100264 | 11/1916 | United Kingdom | 204/225 |

OTHER PUBLICATIONS

Peter M. Paige, *Engineering and Mining Journal*, p. 69, Aug. 1971.

*Primary Examiner*—R. L. Andrews
*Assistant Examiner*—Terryence Chapman
*Attorney, Agent, or Firm*—Pennie & Edmonds

[57] ABSTRACT

In an electrolysis apparatus comprising electrolytic cells (2), in which groups of electrodes are suspended and the longitudinal walls (17) of which are capped with two rows (19, 20) of supports (21, 22) for the suspension lugs (12, 16) of the electrodes, these rows extending on both sides of a median element (23) of electrical connection, and handling means (5) for introducing a group of electrodes in a cell and for withdrawing it therefrom, the supports (21, 22) dominate the median element (23) of electrical connection, the lugs (12, 16) of the electrodes suspended in the cells extend beyond their supports (21, 22) and the handling means (5) are adapted to lift the electrodes by the under-side of the extremities of their lugs (12, 16).

13 Claims, 14 Drawing Figures

ELECTROLYSIS APPARATUS

The present invention relates to an electrolysis apparatus comprising a plurality of electrolytic cells positioned side by side, each cell being adapted to contain a vertically suspended group of electrodes consisting of anodes alternating with cathodes, these electrodes being provided at both their sides with a suspension lug, support and connection means, positioned on the walls separating the adjacent cells, for supporting the suspension lugs of the electrodes and for connecting the cells electrically, these means comprising per wall two rows of supports extending on both sides of a median element of electrical connection, each row comprising supports made of an electroconductive material alternating with supports made of an insulating material, and handling means for introducing a group of electrodes in a cell and for withdrawing it therefrom.

Such an apparatus is described in the document U.S. Pat. No. 4,028,211. In this known apparatus the support and connection means have a plane surface. Hence, when the electrodes are suspended in the cells, their lugs cannot extend beyond their supports and the handling means have no access to the under-side of the lug extremities. The handling means comprise per cathode a pair of pincers that seize the cathodes on both sides of the middle of their suspension bar, and for the anodes as a whole a clutch, the two jaws of which grip the anodes as a whole by a slot provided in their suspension lugs. Hence, these anodes have necessarily huge lugs and, consequently, a high scrap coefficient, the latter being the anode fraction that has to be remelted after electrolysis. Hence, this known apparatus has the drawbacks that the handling means have a complicated construction and that it requires the use of anodes with a high scrap coefficient.

The object of the present invention is to provide an apparatus such as defined before, avoiding the drawbacks of this known apparatus.

In the apparatus according to the invention:

the supports dominate the median element of electrical connection, the lugs of the electrodes suspended in the cells extend beyond their supports, and the handling means are adapted to lift the electrodes by the underside of the extremities of their lugs.

Other details and features of the invention will appear from the description of an embodiment of the apparatus according to the invention, given hereafter as a non-restrictive example and with reference to the enclosed drawings.

DETAILED DESCRIPTION OF THE DRAWINGS

In the various figures the same reference notations indicate identical elements.

Figure 1:
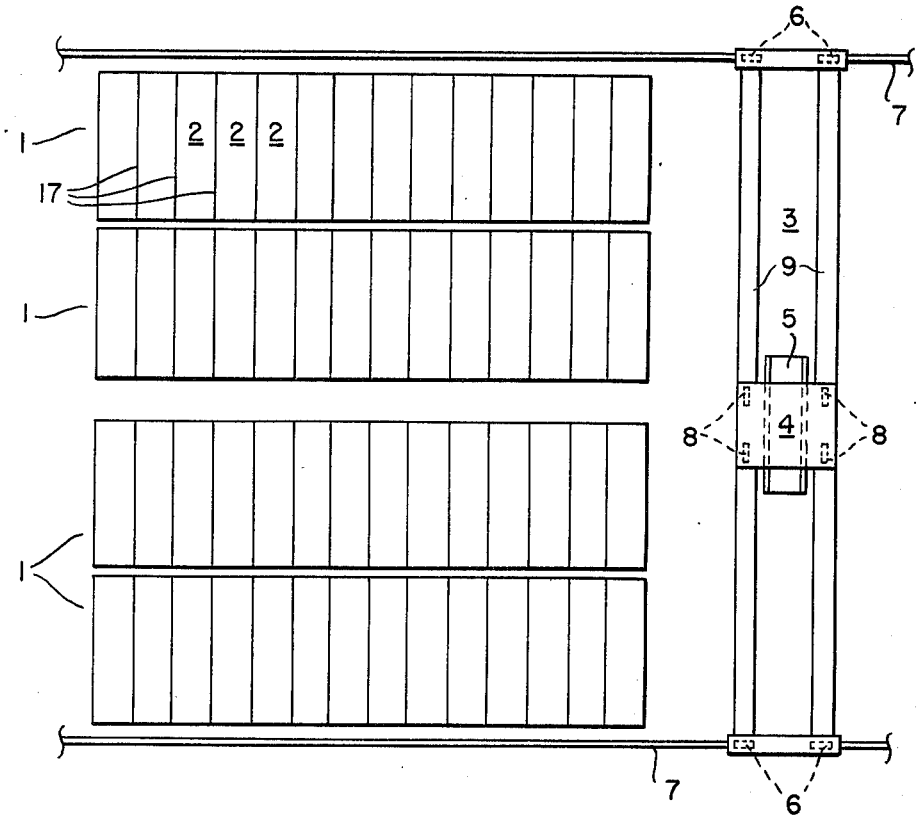
FIG. 1 represents a schematic plan view of an apparatus according to the invention for the electrorefining of copper.

The apparatus shown on FIG. 1 comprises four parallel rows 1 of rectangular electrolytic cells 2, located side by side and an overhead crane 3 with carriage 4 on which a rack 5 is suspended. The overhead crane 3, provided with wheels 6 and driven by a not shown motor can move to-and-fro on rails 7 parallelly to the rows of cells 1. The carriage 4, provided with wheels 8 and driven by a not shown motor, can move to-and-fro on rails 9 fastened to crane 3, transversally to the rows of cells 1. The overhead crane 3 and the carriage 4 are of the usual type and their structure will not be further detailed.

Figure 2:
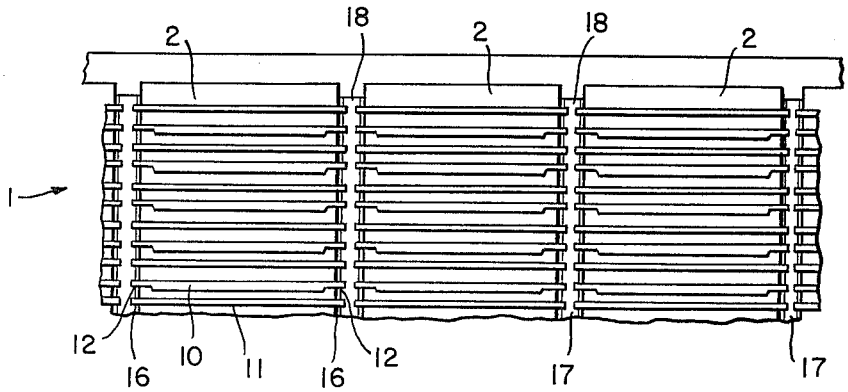
FIG. 2 represents an enlarged and more detailed plan view of a part of three electrolytic cells, positioned side by side, of the apparatus of FIG. 1.
Figure 14:
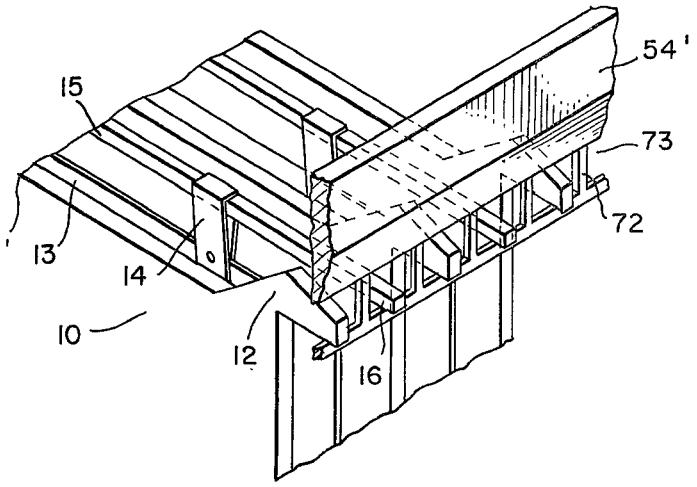

As shown on FIG. 2, each cell 2 comprises a group of electrodes consisting of anodes 10 alternating with cathodes 11. These electrodes are suspended vertically at equal distance and transversally to the longitudinal axis of cell 2. The distance between the axes of two successive electrodes is small, e.g. 49 mm; each cell 2 contains, for instance, thirty-five anodes 10 and thirty-six cathodes 11. An anode 10 consists of a cast plate of impure copper provided at its upper part with two laterally extending lugs 12 (see also FIGS. 12 and 14) enabling to suspend the anode 10 in cell 2. A cathode 11 consists of a pure copper plate 13 provided with two suspension loops 14 through which passes a suspension bar 15. The suspension bar 15 extends beyond the lateral edges of plate 13 so that the extremities 16 of this bar 15 form suspension lugs for cathode 11 (see FIGS. 12 and 14).

Figure 3:
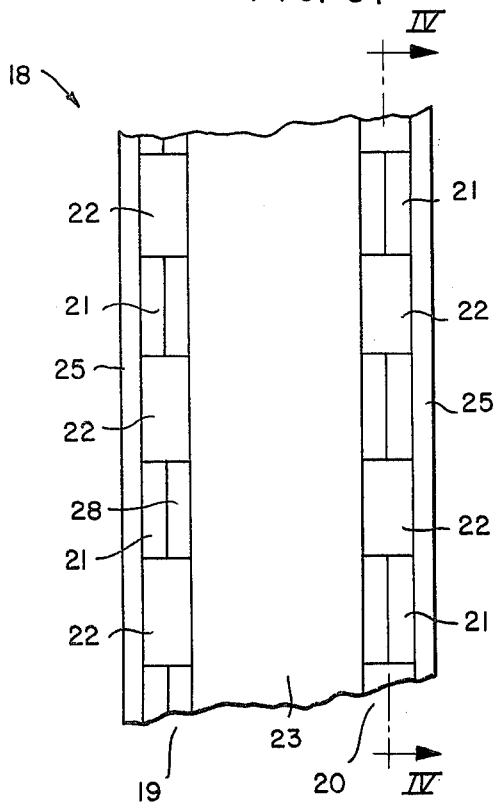
FIG. 3 represents an enlarged more detailed plan view of a part of a supporting and connecting device, mounted on the walls separating two adjacent cells in FIG. 2.
Figure 11:
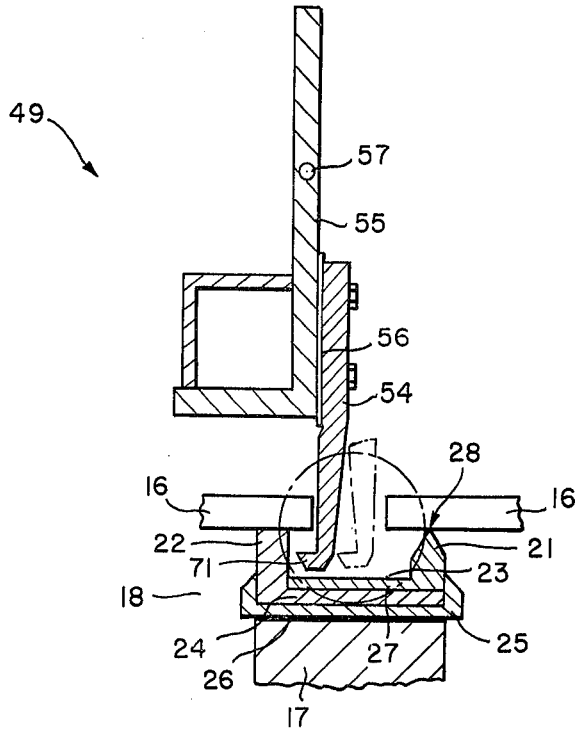
FIGS. 11 and 12 illustrate the operation of the equipment of FIG. 8.
Figure 13:
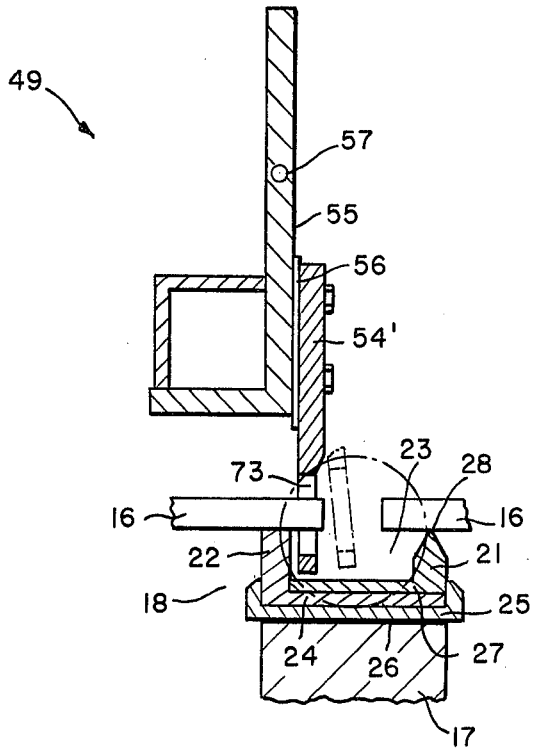
FIGS. 13 and 14 illustrate the operation of an alternative for the equipment of FIG. 8.

A supporting and connecting device 18 is mounted on each wall 17 separating two adjacent cells 2 for supporting the suspension lugs 12 and 16 of the electrodes and for connecting electrically the adjacent cells 2 (see also FIGS. 11 and 13). As shown on FIG. 3, the device 18 comprises a first and a second row 19 and 20 of supports 21 made of an electroconductive material alternating with supports 22 made of an insulating material. These rows extend on both sides of a median element 23 of electrical connection, connecting electrically the electroconductive supports 21 of both rows. The electroconductive supports 21 of the first row 19 are used to support a lug 12 of the anodes 10 contained in cell 2 left of the device 18 and the insulating supports 22 of this row, a lug 16 of the cathodes 11 contained in this cell (or vice versa), whereas the electroconductive supports 21 of the second row 20 are used to support a lug 16 of the cathodes 11 contained in cell 2 right of the device 18 and the insulating supports 22 of this row, a lug 12 of the anodes 10 contained in this cell (or vice versa).

Figure 4:
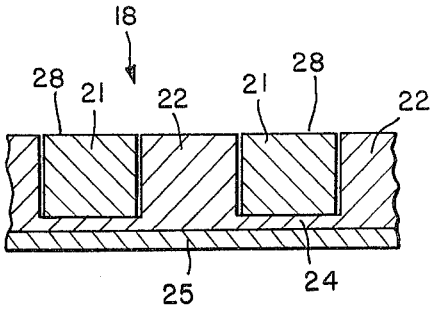
FIG. 4 represents a vertical section through the device of FIG. 5, made along line IV—IV of FIG. 3.

As shown on FIGS. 4, 11 and 13, the device 18 consists, on the one hand, of a body made of polyvinyl chloride, polyester or an other appropriated insulating material comprising a first U-profile 24, the side walls of which are toothed to form the insulating supports 22, and a second U-profile 25, the under-side of which is secured to the upper edge of wall 17 by means of a cement 26 and in which fits the first profile 24, and, on the other hand, of a body made of copper or of an other appropriated electroconductive material consisting of a U-profile 27, the side-walls of which end in a sharp edge 28 and which has notches on both sides so as to fit into profile 24, the teeth of profile 27 forming the electroconductive supports 21.

Figure 5:
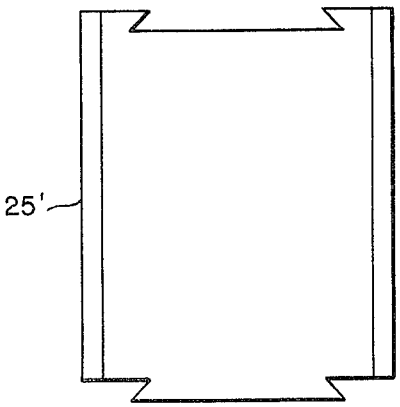
FIG. 5 represents a plan view of a component of the device of FIG. 3.

Profile 25 may consist of one single piece with the same length as wall 17; such a piece is usually manufactured by extrusion. Profile 25 may also consist of a series of short pieces 25' provided with dovetailed assembling elements; such a piece, that is usually manufactured by die casting, is represented on FIG. 5.

Figure 6:
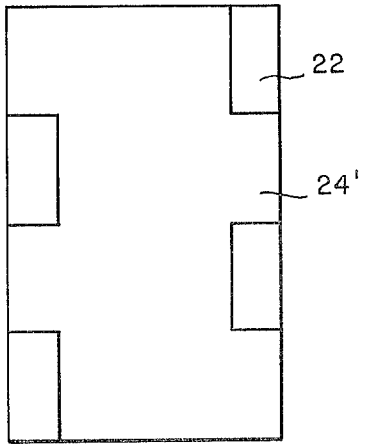
FIG. 6 represents a plan view of an other component of the device of FIG. 3.

To form profile 24 a series of short pieces 24, manufactured by die casting, may be juxtaposed; such a piece is represented on FIG. 6.

A U-profile, the side-walls of which end in a sharp edge, can be manufactured by extrusion; profile 27 is obtained after notching such profile.

The length of the lugs 12 and 16 of the electrodes 10 and 11 is such that these lugs extend beyond their supports 21 or 22, for instance over a distance of about 10 to about 30 mm, so that the rack 5, that will be described hereafter, has access to the under-side of the extremities of these lugs (see FIGS. 11 and 13). In order to enable this access, the distance between said under-side and the upper side of the median element 23 of electrical connection, i.e. the upper side of the base of profile 27, should also be large enough, e.g. about 30 to about 40 mm. It is to be understood that this distance depends on the configuration of the rack element, that must have access to the aforementioned under-side. It is also to be understood that the distance between the lugs, borne by supports facing each other, has to be large enough, e.g. from about 40 to about 60 mm, to enable said access. This distance depends of course on the aforesaid configuration too.

The first and the last cell 2 of each row 1 are connected in the usual way with a non-represented source of current. An appropriated electrolyte flows through the cells 2. The impure anodes 10 dissolve during the electrolysis and a pure copper deposit is formed on the cathodes 11. When the anodes 10 of a cell 2 are exhausted, the group of electrodes contained in this cell and consisting of thin anodes and thick cathodes has to be replaced by a new group of electrodes consisting of thick anodes and thin cathodes. For this replacement of a group of electrodes rack 5, that will be detailed hereafter, is used in combination with the overhead crane 3 and carriage 4.

Figure 7:
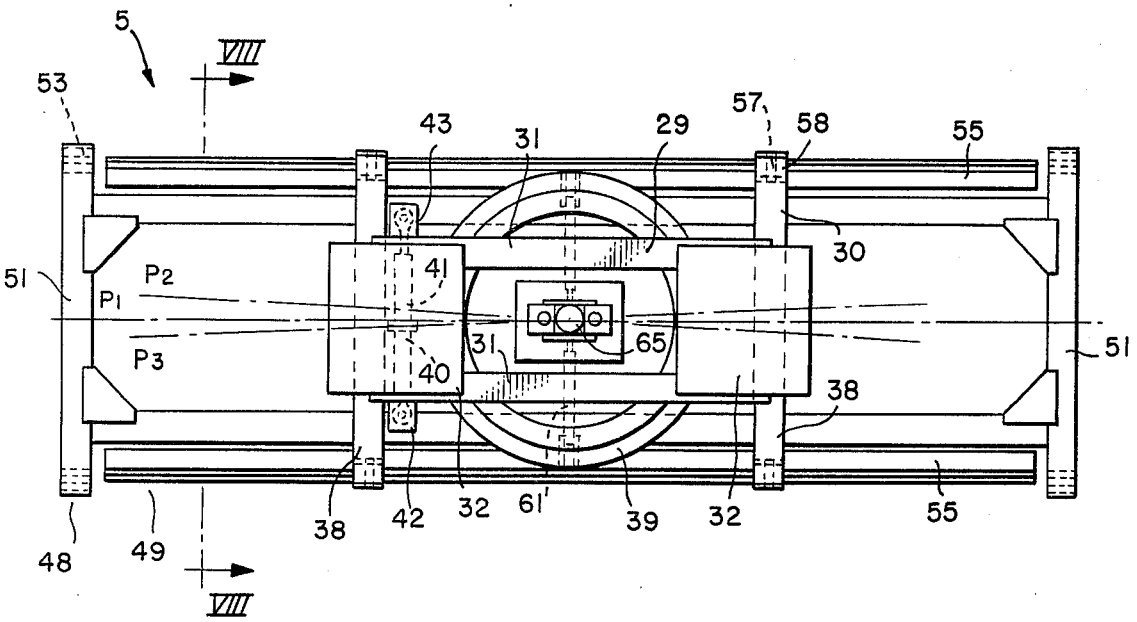
FIG. 7 represents an enlarged and more detailed plan view of a part of a handling equipment of the apparatus of FIG. 1.
Figure 8:
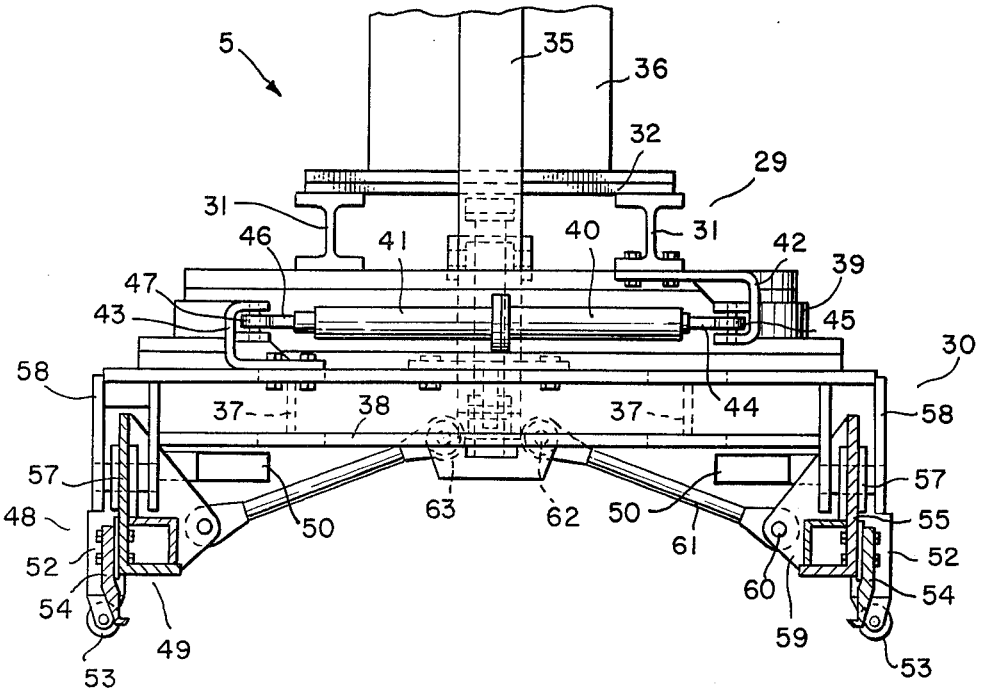
FIG. 8 represents an enlarged section through the equipment of FIG. 7, made along line VIII—VIII of FIG. 7.
Figure 9:
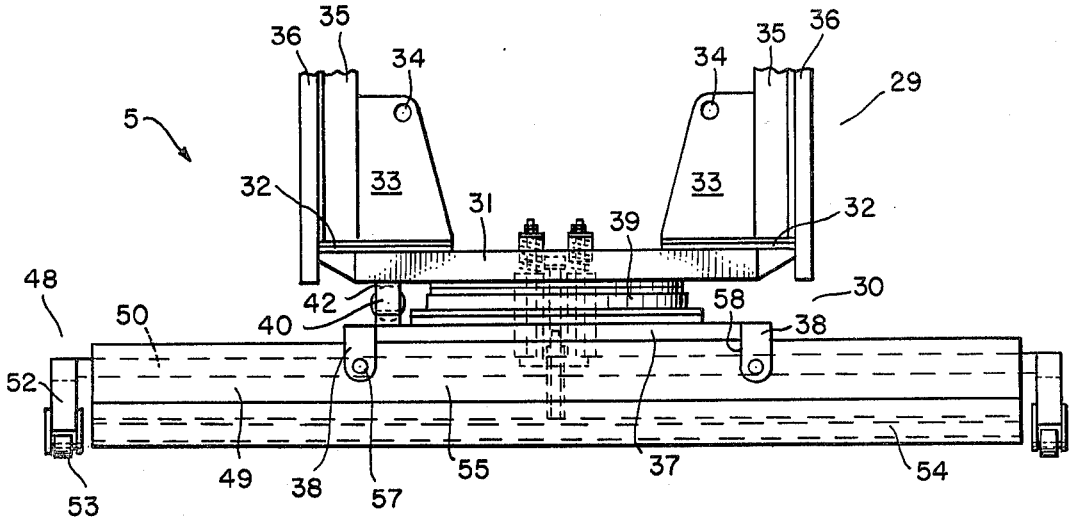
FIG. 9 represents an elevational front view of the equipment of FIG. 7.

As shown in FIGS. 7 to 9, rack 5 comprises an upper yoke 29 and a lower yoke 30. The upper yoke 29 comprises two beams 31 connected by two not represented cross-bars and two transversal plates 32. Both a lug 33 with a suspension eyelet 34 and a vertical guiding element 35 are fastened to each transversal plate 32. The vertical guiding elements 35 glide in the guides 36, secured to carriage 4. Rack 5 is suspended in a usual way by the suspension eyelets 34 to a usual and not represented lifting equipment provided to carriage 4.

The lower yoke 30 comprises two beams 37 connected by two crossbars 38. The lower yoke 30 is connected with the upper yoke 29 by a ball-cage 39. The rotation of the lower yoke 30 around the axis of the ball-cage 39 is caused by a couple of hydraulic cylinders 40 and 41, mounted back to back between a loop 42 secured to the upper yoke 29 and a loop 43 secured to the lower yoke 30. Rod 44 of cylinder 40 pivots at its extremity on hinge 45 secured in loop 42. Rod 46 of cylinder 41 pivots at its extremity on hinge 47 secured in loop 43. When rod 44 of cylinder 40 is completely in and rod 46 of cylinder 41 is completely out, the longitudinal axis of the lower yoke 30 is in position P1 (see FIG. 7) in which this axis is parallel to the longitudinal axis of the upper yoke 29. When rod 44 of cylinder 40 is pushed outwards, the longitudinal axis of the lower yoke 30 passes from position P1 to position P2. When rod 46 of cylinder 41 is moved inwards, the longitudinal axis of the lower yoke 30 passes from position P1 to position P3. Hence, the lower yoke 30 may be brought in any position between the extreme positions P2 and P3, which depend of course on the stroke of the cylinders 40 and 41. P2 and P3 form an angle of e.g. 10°. No need to say that this angle should be adapted to the degree of lack of parallelism between the various cells.

The lower yoke 30 bears a landing-train 48 and a seizing device 49. the landing-train 48 comprises two beams 50 fastened under yoke 30 and two cross-bars 51, the extremities of which bear a leg 52 provided with a wheel 53. The landing-train 48 ensures that the two jaws 54 of the seizing device 49 always remain separated from the aforesaid median elements 23 of electrical connection, so that they cannot damage these elements.

The seizing device 49 comprises two reinforced L-profiles 55, to which are secured the already mentioned jaws 54, and means for moving the profiles 55. The jaws 54 are electrically insulated from the profiles 55 and 56 (see FIG. 11). Each profile 55 is borne by two hinges 57, mounted in loops 58 fastened to the extremities of the aforesaid cross-bars 38. Each profile 55 is connected through a blade 59, a jointed coupling 60, a rod 61 and a jointed coupling 62 to a central plate 63 being connected with a rod 64 of a vertical hydraulic cylinder 65 (see FIGS. 8 and 10). When rod 64 of cylinder 65 is moved outwards, plate 63 comes down and the two jaws 54 move off from each other, i.e. the seizing device 49 opens. When rod 64 of cylinder 65 is moved inwards, plate 63 lifts and the two jaws 54 come nearer to each other, i.e. the seizing device 49 closes.

Figure 10:
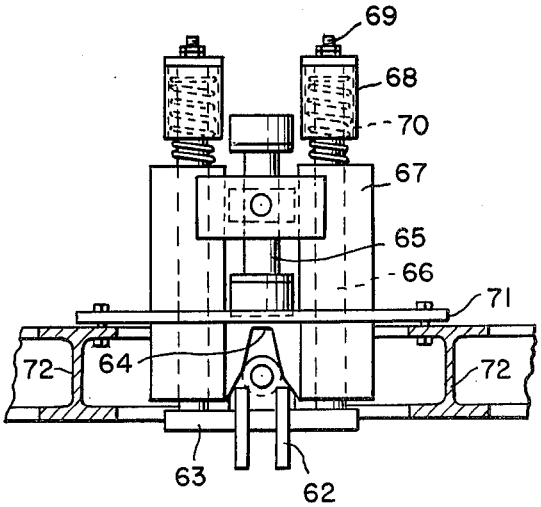
FIG. 10 represents an enlarged and more detailed view of the central part of the equipment of FIG. 9.

As shown in FIG. 10, plate 63 is secured to two guide-rods 66 gliding in the guides 67. The guide-rods 66 are capped with a socket 68, the position of which can be adjusted by nut 69. The distance between the lower edge of these sockets 68 and the upper edge of the guides 67 determines the stroke of cylinder 65. Hence, it is possible to control this stroke by adjusting the position of the sockets 68. The guide-rods 66 are equipped with a spiral spring 70, that rests on guide 67 and that is compressed when the cylinder 65 brings down plate 63. Hence, these springs 70 prevent this plate from coming down, i.e. the opening of the seizing device 49, when for whatever reason cylinder 65 stops operating. Cylinder 65 and guides 67 are mounted on a support 71, that is secured to two cross-bars 72 connecting the aforesaid beams 37.

Figure 12:
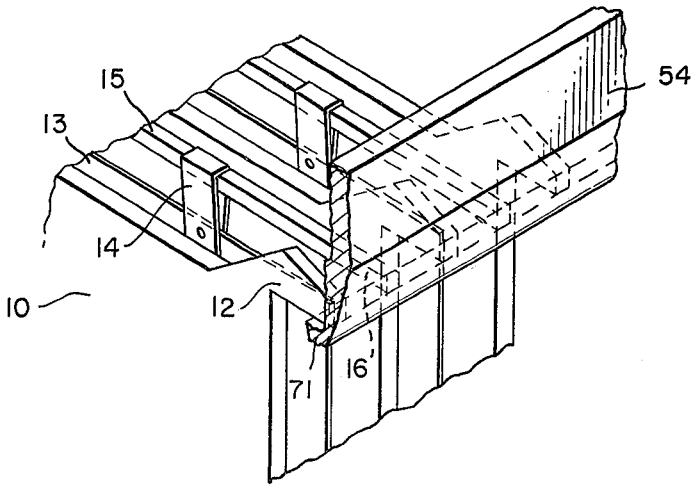

As shown on FIGS. 11 and 12, the jaws 54 end in a foot 71 to support the lugs 12 and 16 of the electrodes 10 and 11. An other type of jaw is shown on FIGS. 13 and 14. The jaw 54' ends in a grate 72 with as many meshes 73 as there are electrodes to bear.

The above described apparatus can be operated as follows. When in a cell a group of electrodes has to be replaced, carriage 4 is brought above this cell and rack 5, the seizing device 49 of which is open, is brought down until the two jaws 54 or 54' come close to the lugs 12 and 16 of the group of electrodes to be replaced. By means of cylinders 40 and/or 41 the orientation of the jaws 54 and 54' is now adjusted, if necessary, so that these jaws are parallel to the subjacent devices 18. The rack is further lowered until the wheels 53 of the landing-train 48 rest on the extremities of the two walls 17 of the cell. At that moment, jaws 54 and 54' stand in the position indicated by dotted lines on FIGS. 11 and 13. Then the seizing device 49 is closed, i.e. jaws 54 or 54' are brought in the vertical position, and rack 5 is lifted. While lifting rack 5, the jaws 54 and 54' come into contact with the under-side of the extremeities of lugs 12 and 16 of the electrodes and lift the group of electrodes as shown on FIGS. 12 and 14. Rack 5 is then conveyed to a non-represented unit where it sets down its load of thin anodes and thick cathodes and from where it returns with a load of thick anodes and thin cathodes, that it sets down in the cell.

It is to be understood that the apparatus of invention is by no means restricted to the above described embodiment and that it can be modified in many ways, without leaving the scope of the present patent application.

So, for instance, the before described apparatus has been designed to apply the Walker electrorefining process, according to which the anodes of two adjacent cells are in line. It is clear that this apparatus can be easily adapted to apply the Whitehead electrorefining process, according to which the anodes of a first cell are in line with the cathodes of a second cell, that is adjacent to the first one. To this end it is sufficient to adapt device 18.

The side walls of the U-profile 27 may, for instance, end in a rounded section instead of in a sharp edge.

The U-profile 25 may be replaced by an other appropriated profile or deleted, but in the latter case the U-profile 24 must be secured to the upper edge of wall 17, which complicates the replacement of this profile 24.

If the walls 17 of all cells 2 are perfectly parallel, which is not often the case in existing electrolytic plants, the non-pivoting upper yoke 29 and the pivoting lower yoke 30 may be replaced by one single non-pivoting yoke.

The landing-train 48 may be deleted but it is clear that this modification complicates the handling of rack 5.

The springs 70 may be deleted, but then one risks to drop by accident a group of electrodes, when for a whatever reason cylinder 65 stops operating.

The sockets 68 may be deleted but then it becomes impossible to ajust the stroke of cylinder 65.

The hydraulic driving means 40, 41 and 65 may be replaced by pneumatic or electric driving means.

We claim:

1. An electrolysis apparatus comprising a plurality of electrolytic cells (2) positioned side by side, each cell being adapted to contain a vertically suspended group of electrodes consisting of anodes (10) alternating with cathodes (11), these electrodes being provided at both their sides with a suspension lug (12, 16), support and connection means (18), positioned on the walls (17) separating the adjacent cells, for supporting the suspension lugs of the electrodes and for connecting the cells electrically, these means comprising per wall two rows (19, 20) of supports (21, 22) extending on both sides of a median element (23) of electrical connection, each row comprising supports made of an electroconductive material (21) alternating with supports made of an insulating material (22), and handling means (5) for introducing a group of electrodes in a cell and for withdrawing it therefrom, characterized in that the supports (21, 22) dominate the median element (23) of electrical connection, the lugs (12, 16) of the electrodes suspended in the cells extend beyond their supports (21, 22), and the handling means (5) are adapted to lift the electrodes by the under-side of the extremities of their lugs (12, 16)

2. The apparatus according to claim 1, characterized in that the support and connection means (18) comprise a U-profile made of an insulating material (24), the side walls of which are toothed, and a U-profile made of an electroconductive material (27) having notches on both sides and fitting into the first aforesaid profile (24).

3. The apparatus according to claim 2, characterized in that the upper part of the side walls of the profile made of an electroconductive material (27) has a triangular section.

4. The apparatus according to claim 2, characterized in that the upper part of the side walls of the profile made of an electroconductive material (27) has a rounded section.

5. The apparatus according to claims 2, 3 or 4, characterized in that the support and connection means comprise a second U-profile made of an insulating material (25) in which fits the aforesaid first profile (24).

6. The apparatus according to claim 1, characterized in that the handling means (5) comprise a yoke (30) bearing a seizing device (49), that comprises a pair of jaws (54 or 54') ending downwards in a bearing element (71 or 72) for the lugs of the electrodes, and means (55, 57, 59–67) for bringing the jaws nearer to each other and for moving them away from each other.

7. An electrolysis apparatus comprising a plurality of electrolytic cells positioned side by side, a group of electrodes consisting of anodes alternating with cathodes adapted to be suspended vertically in each cell, and each electrode being provided at both of its sides with a suspension lug, support and connection means, said support and connection means positioned on the wall separating adjacent cells for supporting the suspension lugs of the electrodes and for connecting the cells electrically, said support and connection means comprising per wall two rows of supports extending on both sides of a median element of electrical connection, each row of supports comprising supports made of an electroconductive material alternating with supports made of an insulating material and handling means for introducing said group of electrodes in a cell and for withdrawing the electrodes therefrom, characterized in that the supports dominate the median element of electrical connection, the lugs of the electrodes suspended in the cells extend beyond their supports and the handling means are adapted to lift the electrodes by the underside of the extremities of their lugs, said handling means comprise a yoke, a seizing device carried by said yoke and comprising a pair of jaws each having a bearing element at the downward end for lifting the under-side of the extremeties of the lugs of the electrodes, locating means for locating the jaws nearer to each other and for moving the jaws away from each other, and wherein said jaw is secured to a beam mounted on hinges, each beam bearing a blade that is connected through a jointed coupling with the extremity of a rod, and wherein the other extremity of the rod is connected through a jointed coupling with a central plate adapted to move vertically.

8. The apparatus according to claim 7 characterized in that the central plate (63) is connected with the rod (64) of a downwards pointed hydraulic cylinder (65) and secured to the lower extremity of vertical guide-rods (66) that glide in guides (67).

9. The apparatus according to claim 8 characterized in that the guide-rods (66) are taller than the guides (67) and that the upper part of the guide-rods (66) is surrounded by a spiral spring (70) that rests on the guides (67) and that is compressed when cylinder (65) brings down the plate (63).

10. The apparatus according to claim 8, characterized in that the guide-rods (66) are taller than the guides (67), that they are capped with a socket (68), which is adapted to rest on the guides (67) when the cylinder (65) brings down the plate (63), and that they are provided with means (69) for changing the position of the socket (68).

11. An electrolysis apparatus comprising a plurality of electrolytic cells positioned side by side, a group of electrodes consisting of anodes alternating with cathodes adapted to be suspended vertically in each cell, and each electrode being provided at both of its sides with a suspension lug, and connection means, said support and connection means positioned on the wall separating adjacent cells for supporting the suspension lugs of the electrodes and for connecting the cells electrically, said support and connection means comprising per wall two rows of supports extending on both sides of a median element of electrical connection, each row of supports comprising supports made of an electroconductive material alternating with supports made of an insulating material, and handling means for introducing said group of electrodes in a cell and for withdrawing the electrodes therefrom, characterized in that the supports dominate the median element of electrical connection, the lugs of the electrodes suspended in the cells extend beyond their supports and the handling means are adapted to lift the electrodes by the under-side of the extremities of their lugs, said handling means comprise a yoke, a seizing device carried by said yoke and comprising a pair of jaws each having a bearing element at the downward end for lifting the under-side of the extremities of the lugs of the electrodes, locating means for locating the jaws nearer to each other and for moving the jaws away from each other, and wherein the yoke also includes a landing train which ensures that the bearing elements of the jaws at all times remain distant from the median elements of electrical connection.

12. An electrolysis apparatus comprising a plurality of electrolytic cells positioned side by side, a group of electrodes consisting of anodes alternating with cathodes adapted to be suspended vertically in each cell and each electrode being provided at both of its sides with a suspension lug, and connection means, said support and connection means positioned on the wall separating adjacent cells for supporting the suspension lugs of the electrodes and for connecting the cells electrically, said support and connection means comprising per wall two rows of supports extending on both sides of a median element of electrical connection, each rows of supports comprising supports made of an electroconductive material alternating with supports made of insulating material, and handling means for introducing said group of electrodes in a cell and for withdrawing the electrodes therefrom, characterized in that the supports dominate the median element of electrical connection, the lugs of the electrodes suspended in the cells extend beyond their supports and the handling means are adapted to lift the electrodes by the under-side of the extremities of their lugs, said handling means comprise a yoke, a seizing device carried by said yoke and comprising a pair of jaws each having a bearing element at the downward end for lifting the under-side of the extremities of the lugs of the electrodes, locating means for locating the jaws nearer to each other and for moving the jaws away from each other, and wherein the handling means also comprise an upper yoke to which the yoke first-mentioned is suspended, the suspension being completed by a ball-cage and pivot means for causing said first-mentioned yoke to pivot.

13. The apparatus according to claims 6, 8, 9, 10, 13 or 14, characterized in that the handling means (5) comprise moreover an upper yoke (29) to which the yoke (30) is suspended through a ball-cage (39), and means (40–47) for causing the lower yoke (30) to pivot.

* * * * *